US007025115B2

(12) United States Patent
Doty

(10) Patent No.: US 7,025,115 B2
(45) Date of Patent: Apr. 11, 2006

(54) LADLE FOR MOLTEN METAL

(75) Inventor: Herbert W. Doty, Amherst, NH (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/915,986

(22) Filed: Aug. 11, 2004

(65) Prior Publication Data

US 2006/0032603 A1 Feb. 16, 2006

(51) Int. Cl.
*B22D 39/00* (2006.01)

(52) U.S. Cl. ..... 164/136; 222/590

(58) Field of Classification Search ..... 164/136, 164/336; 222/590, 629
See application file for complete search history.

(56) References Cited

U.S. PATENT DOCUMENTS 3,514,018 A * 5/1970 Apelt et al. ..... 222/629
3,923,201 A 12/1975 Hersh et al.
4,074,837 A * 2/1978 Engel ..... 222/629
4,188,721 A 2/1980 Ramun et al.
4,516,699 A * 5/1985 Burton et al. ..... 222/591
4,560,318 A 12/1985 Rodgers et al.
5,011,120 A * 4/1991 Bear ..... 266/240
5,131,452 A * 7/1992 Bilz et al. ..... 164/136
5,967,219 A 10/1999 Lumppio
5,996,677 A 12/1999 Woodhouse
6,506,337 B1 1/2003 Sieradzki
6,619,373 B1 9/2003 Tooley et al.
6,779,585 B1 * 8/2004 Zumberger et al. ..... 164/136
2004/0055731 A1 3/2004 Zumberger et al.

* cited by examiner

*Primary Examiner*—Len Tran
(74) *Attorney, Agent, or Firm*—Kathryn A. Marra

(57) ABSTRACT

A method and apparatus for the quiescent-fill dip of a foundry ladle and the transportation of molten material from a crucible to a mold through a foundry pour basin. Advantages from this process include, among others, a design which minimizes or eliminates turbulence in the molten material, especially in regard to the folding of one stream of molten material into another, as a means to provide undamaged metal to casting molds.

12 Claims, 6 Drawing Sheets

LADLE FOR MOLTEN METAL

FIELD OF THE INVENTION

The present invention relates to an apparatus and method for pouring a molten material, such as molten metal, into a casting mold that yields improved mechanical properties of castings and minimizes detriments.

BACKGROUND OF THE INVENTION

Pouring molten metal into a casting is a significant process variable that influences the internal soundness, surface conditions, and mechanical properties, such as tensile strength, porosity, percent elongation and hardness, of metal castings. Many different designs for dipping/pouring ladles exist and are used in the foundry industry. The designs are normally chosen based upon the type of molten material and casting mold used. Commonly used ladles make use of either a slot, lip and baffle, or a dam at the top of the ladle to reduce inclusion of furnace dross metal during metal filling, or they use a stopper rod to control the flow of metal into or out of the ladle.

Molten metals, such as aluminum, react with the air and instantaneously create oxides, commonly known as dross, which upon mixing with the rest of the molten metal creates inclusions and highly porous regions during solidification of the metal. While many factors influence and account for these undesirable properties, two common sources of inclusions include the dross layer formed on top of the molten metal, and the folding action of the molten metal caused by the vertical and horizontal momentum of the molten metal established during pouring.

Increased momentum gives rise to turbulent metal flow. Turbulent metal flow exposes more metal surface area to the air which creates the dross, or metallic oxide layer. Depending on the velocity of the molten metal, dictated by the pouring ladle and basin design and use, the molten metal may fold-over itself many times, thereby trapping these oxides and exposing still further surface area to the air.

Many current foundry ladles can be referred to as typical teapot-type ladles. These ladles are substantially cylindrically shaped with an external spout outwardly extending at the top. Certain teapot ladles have incorporated a wall, or baffle, which separates the large bowl or cavity area of the ladle from the spout and extends almost to the bottom of the ladle. When the molten material is poured, this baffle restricts the flow of molten metal to that which is near the bottom of the ladle, which is normally free from dross and any other foreign material that may be present, such as eroded refractory lining and ash from the fuel during the melting process. Although the baffle serves to minimize dross inclusion, the external spout design still increases the velocity of the material upon pouring, and may create turbulent flow.

Molten material is typically transferred from the ladle to the casting mold through a pour basin. In traditional pour basin designs, molten material flows down the basin to a mold sprue juxtaposed to a horizontal wall. Even traveling at a low velocity, if the molten material hits this square impact it often causes excessive turbulence in the molten material that leads to a folding over of the material, which in turn traps dross and metal oxides that are present on the molten material surface. This leads to inclusion of non-metallic particles into the casting that can reduce its mechanical properties. Non-conforming properties can lead to severe machinability problems and increase the propensity of undesired porosity during the subsequent solidification of the molten material.

Low pressure, bottom pour furnaces have been known to produce castings with minimal inclusion of dross and low porosity, but the equipment is costly, complex, and subject to high maintenance requirements. In addition, these furnaces require a significant capital cost requirement. Hot Isostatic Pressing (HIPping) of castings can also reduce porosity in aluminum castings, however this presently costs about $1 per pound to process the castings, and the castings cannot have any surface-connected porosity or the pores will not close. In addition, HIPping may cause dimensional changes to the casting that may not be uniform or repeatable.

Thus, there remains a need for an economical method and apparatus that would prevent or minimize the inclusion of dross and contaminants leading to high porosity and/or low mechanical properties of cast materials.

SUMMARY OF THE INVENTION

The present invention relates to and discloses a foundry ladle and basin apparatus and method for their use in the quiescent-fill dip of a foundry ladle and the transportation of molten material from a crucible to a mold through a foundry pour basin. Advantages of the present invention include, among others, a method of pouring molten material that minimizes or eliminates turbulent flow, especially in regard to the folding of one stream of molten metal into another, as a means to provide undamaged metal to casting molds.

According to one aspect of the present invention, a quiescent-fill foundry ladle is designed to minimize the inclusion of non-metallic particles into castings. The ladle is a substantially barrel-shaped vessel with two side walls of substantially the same diameter. It is operable to rotate about an eccentric axis of rotation via an axle positioned through aligned openings in the walls. A retractable cylinder mechanism is provided to engage the rotation of the ladle about the axle. An opening in the top of the ladle receives and discharges molten material through a smooth, rounded, shaped spout cut-out of one end of the opening.

According to a further feature of the ladle, the pouring process is controllable by an automated foundry robot, such as those commercially available from ABB Ltd. of Sweden. The ladle attaches to the robot with a flange connected to its axle. This arrangement allows the ladle to be raised, lowered, and transported robotically.

In another aspect of the present invention, a foundry pour basin is designed to be used in conjunction with the quiescent-fill ladle. This combination is designed for a minimal metal drop from the ladle to the pour basin. The pour basin receives and transfers molten material from the ladle to a casting mold with minimal turbulence and/or fold-over. The basin consists of a cavity with a mold sprue. The cavity is defined by a bottom wall and a four-sided outer peripheral wall. It is substantially trapezoidally shaped with two side walls, and has a front wall of a front portion parallel to a rear wall of a widened rear portion. The rear wall is angled upward and outward, thus eliminating a square impact of the molten material on the back portion of the pour basin. The sides of the basin flare out as the metal travels deeper into the basin to reduce acceleration of the metal. The bottom wall of the pour basin has a shallow angle path toward the mold sprue which enables the velocity of the molten material to be maintained below about 0.5 meters per second.

In still another aspect of the present invention, a method of quiescent filling the ladle is disclosed. The method includes: (1) positioning the ladle in a rest position over a furnace dip well or crucible; (2) lowering the ladle to the surface of the melt and making initial contact between the ladle and the molten material; (3) rotating the ladle and exposing a portion of the ladle opening to the molten material; (4) lowering the ladle to a predetermined depth into the crucible; (5) rotating the ladle back to its rest position; (6) raising the ladle containing molten material from the crucible; (7) positioning the ladle over the pour basin; and (8) transferring the molten material from the ladle to the pour basin.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
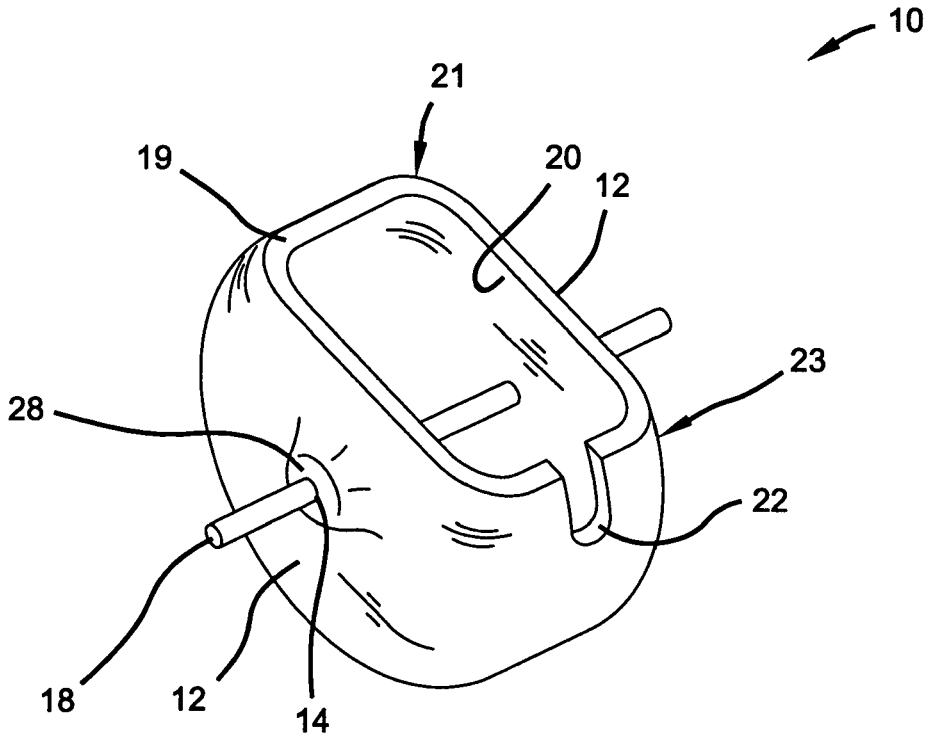
FIG. 1 is an isometric front view of a foundry ladle with a top opening according to the principles of the present invention.

The following description of the preferred embodiment(s) is merely exemplary in nature and is in no way intended to limit the invention, its application, or uses.

With reference to FIGS. 1–4, a ceramic foundry ladle according to the principles of the present invention is shown and generally designated by reference numeral 10. Preferably, ladle 10 comprises castable fused silica. Ladle 10 is a substantially barrel-shaped vessel having two side walls 12 of substantially equal diameter. The two side walls 12 include first and second diametrically opposed axially aligned openings 14 positioned such that axle 18 can be placed through ladle 10. Ladle 10 is operable to rotate about axle 18. Preferably, openings 14 are located slightly off-center, allowing ladle 10 to rotate about an eccentric axis of rotation 16.

The top portion of ladle 10 defines a rim 19 and a third opening 20 which is operable to receive and discharge the molten material from ladle 10. It should be appreciated that opening 20 can vary in size and may be dictated by the type of molten material and/or pour basin used. In a preferred embodiment, top opening 20 consists of a planar aperture of between about 60 and about 180° of the vertical circumference of ladle 10. Most preferably, the angle is between about 60 and about 90°, as depicted by angle $\gamma$ in FIG. 4. The use of a smaller opening enables the preservation of heat in the molten material during the transfer process. It also provides a cavity with adequate room for any sloshing movement of the molten material during transport from the crucible to the pour basin or mold. It should be understood that while planar apertures are preferred, opening 20 may be notched with a V-shaped or U-shaped indentation, scalloped, or otherwise slotted or shaped. At the lower end of the rim 19 of top opening 20 is a spout 22 having a smooth, rounded, cut-out shape. Spout 22 is located in a perpendicular plane relative to a plane containing side walls 12. In a preferred embodiment, spout 22 comprises a curved cut-out with the radius of about 1.5 inches. It should be understood that this radius can be larger or smaller depending on the overall size of the ladle used. Further, spout 22 need not necessarily be circularly shaped.

Figure 2:
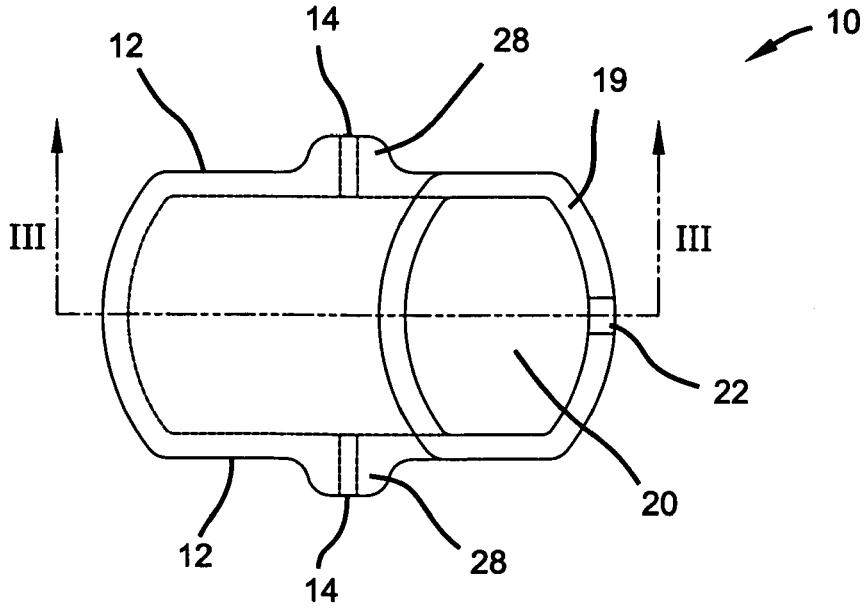
FIG. 2 is a top view of the ladle of FIG. 1.
Figure 4:
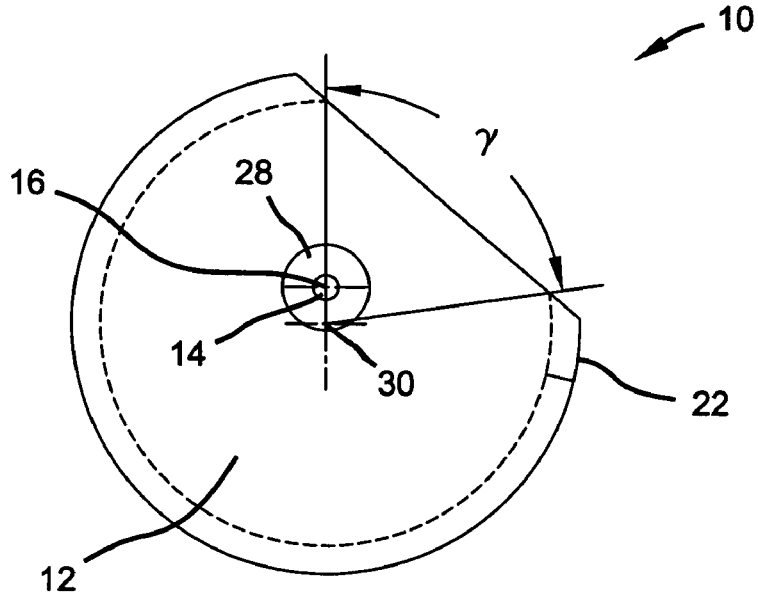
FIG. 4 is a side view of the ladle.

As shown in FIGS. 1, 2, and 4, side walls 12 of ladle 10 may each include a collar 28 appending from axially aligned opening 14. Each upstanding collar extends outwardly from the exterior of the ladle providing torsional support and a bearing surface for axle 18. The size of collar 28 and the distance it extends outward from ladle 10 will be determined based on the overall size of ladle 10 and the capacity and weight of ladle 10 when filled with molten material. Ladle capacities can normally range from as low as less than 10 lbs., to forty tons and greater, mainly depending on the size of the mold to be cast. In a preferred embodiment, ladle 10 should have a useable capacity of at least about 100 lbs. of molten material.

Figure 3:
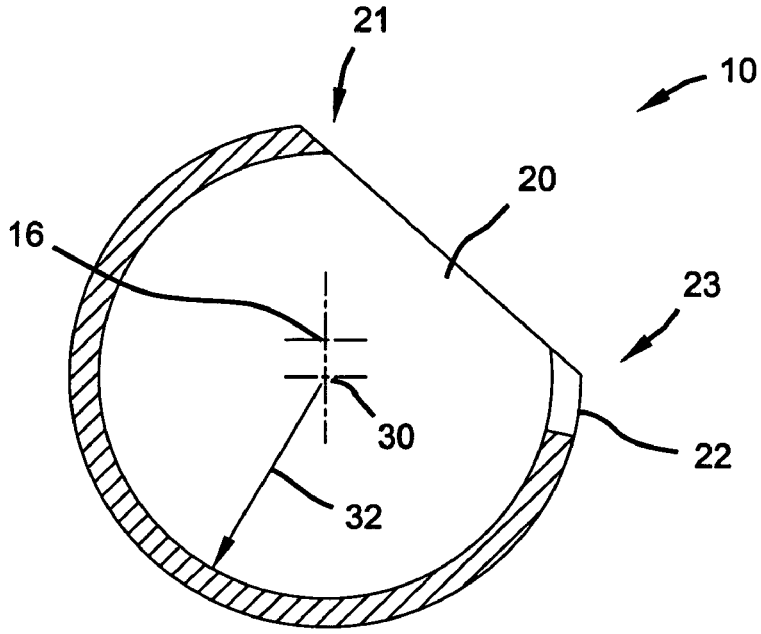
FIG. 3 is a cross-sectional side view of the ladle along the line III—III of FIG. 2.

With reference to the cross-sectional side view of FIG. 3, the axis of rotation 16 of ladle 10 is preferably offset from the center 30 of side wall 12 thereby creating an eccentric axis of rotation. This offset axis increases the volume capacity of ladle 10. Alternatively, ladle 10 could rotate about the center axis without any loss in benefits. In a preferred embodiment, radius 32 of ladle 10 is about 11 inches, the linear distance between the side walls 12 is about 11 inches, and the overall thickness of the walls of ladle 10 is about 1 inch thick. Distinguished from existing ladles having a slot or dam, in one preferred embodiment, spout 22 does not have a pour lip outwardly extending from ladle 10. In certain alternate embodiments, it may be desired to have a minimal lip extension less than about ½ inch, in order to prevent any dribbling of molten material that may occur at the commencing of the pour. This unique design reduces the horizontal velocity of the molten material upon exiting spout 22 and entering a pour basin.

Figure 8:
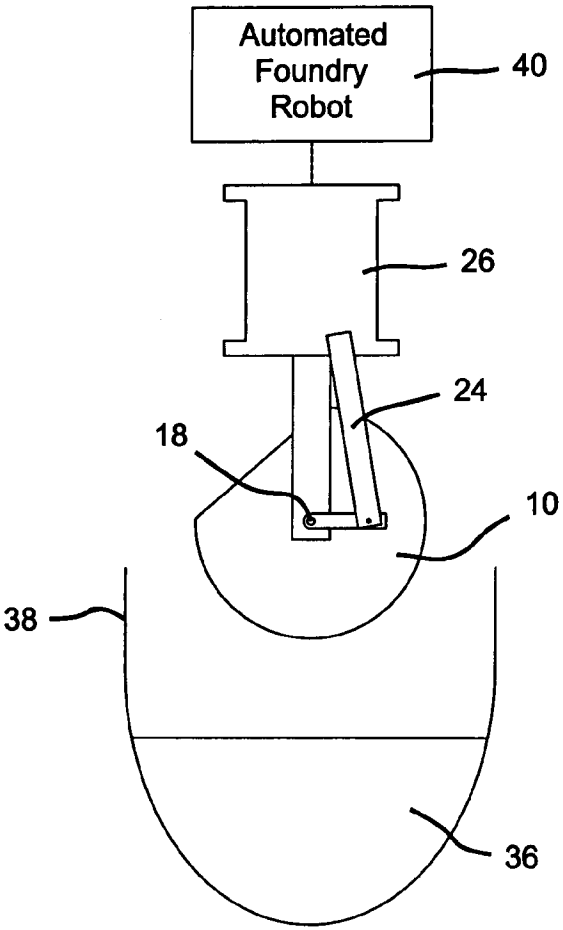
FIG. 8 is a diagrammatic representation of the ladle in its rest position above a crucible.

As shown in FIG. 8, in one aspect of the present invention, ladle 10 can be used together with a flange 26 that preferably connects to ladle axle 18. Flange 26 can attach to an automated foundry robot, or robotic mechanism 40, which would be operable to raise, lower, and rotate ladle 10. Rotation of ladle 10 can be accomplished through the use of a retractable cylinder mechanism 24 which uses a simple piston movement to rotate ladle 10 about its eccentric axis 16. It should be appreciated that flange 26 and retractable cylinder mechanism 24 is but one way to move and rotate ladle 10. Other methods could use "back-hoe" movement similar to that known in the art. Examples include such devices as can be found in U.S. Pat. Nos. 4,188,721 and 4,560,318, hereby incorporated by reference.

Although not depicted, ladle 10 could additionally incorporate a ceramic wall or baffle, that would separate the cavity of ladle 10 from spout 22. Such a baffle could extend about two-thirds of the distance to the bottom of ladle 10. As a baffled ladle is rotated to pour molten metal, the metal would flow from the bottom of a ladle, up around the baffle, and out through spout 22. Metal taken from the bottom of a ladle, would be substantially free of slag, dross, and/or pieces of eroded refractory.

Figure 5:
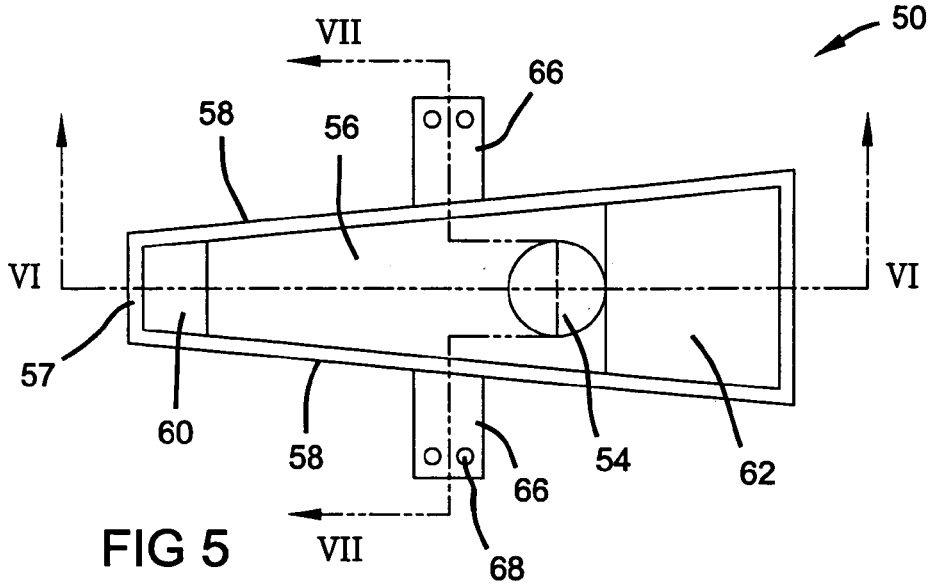
FIG. 5 is a top view of a pour basin according to the principles of the present invention.
Figure 6:
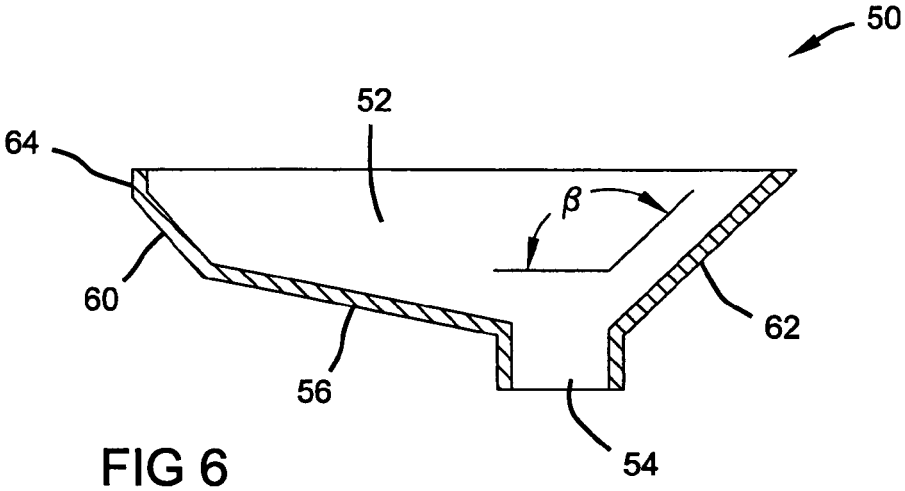
FIG. 6 is a cross-sectional side view of the pour basin along the line VI—VI of FIG. 5.
Figure 7:
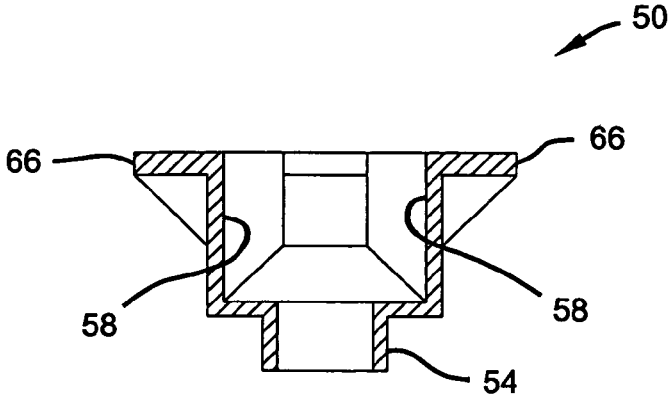
FIG. 7 is a cross-sectional side view of the pour basin along the line VII—VII of FIG. 5.

Referring to FIGS. 5, 6, and 7, a foundry pour basin according to the principles of the present invention is shown and generally designated by reference numeral 50. Pour basin 50 is designed to receive and transfer molten material from ladle 10 into a casting mold. Pour basin 50 consists of a basin cavity 52 with a mold sprue 54. Basin cavity 52 is defined by a bottom wall 56 and a four-sided outer perimeter wall 57 comprising two side walls 58, and a front wall 60 of a front portion which is parallel to an upwardly and outwardly facing rear wall 62 of a widened rear portion. In one aspect of the present invention, front wall 60 may also include a small vertical portion 64. This increases the metal-holding capacity of the basin, while limiting the length of the basin to reduce space restrictions and to minimize temperature loss. The front portion of pour basin 50 accepts the molten metal from ladle 10 and allows a laminar transfer down bottom wall 56 to mold sprue 54 located in the rear portion of pour basin 50. The transfer of molten metal across bottom wall 56 is preferred to travel at a velocity of less than about 0.5 meters per second. This can be accomplished by utilizing a shallow angle path from front wall 60 to mold sprue 54 using a vertical drop of less than 4 inches from the front portion to the rear portion of pour basin 50. Side walls 58 flare out from front to rear so that as metal travels deeper into the basin the acceleration is reduced.

In a preferred embodiment, pour basin 50 is designed to incorporate a minimal metal drop of less than 1 inch from ladle 10 to the bottom of the front portion of pour basin 50. The metal then travels down a shallow angle path bottom wall 56 toward mold sprue 54. The sides 58 of pour basin 50 flare out as the metal travels further into the pour basin to reduce acceleration of the molten metal. Rear wall 62 of pour basin 50 is angled outward and upward to eliminate a square impact of the molten metal on the rear portion. In a preferred embodiment shown in FIG. 6, the angle β between the mold sprue 54 and rear wall 62 is greater than 90°. Ideally, angle β is about 110°.

In one embodiment, as shown in FIGS. 5 and 7, pour basin 50 can include flanges 66 connected to side walls 58 enabling pour basin 50 to be connected to a mechanical mechanism that could raise, lower, and transport the pour basin, if desired. Flange 66 could be designed in a variety of ways including incorporating screw holes 68 as depicted in FIG. 5. Preferably pour basin 50 is made of a thermally insulating, ceramic, fused silica material or equivalent as known in the art. In a preferred embodiment, the overall dimensions of pour basin 50 include a depth of about 8 inches, a front portion of about 5½ inches *wide*, a rear portion of about 11 inches wide, and a length of about 32 inches from front to rear. The walls of pour basin 50 are about ¾ inch thick.

Referring to FIGS. 8–13, a quiescent-fill method of transferring molten material from a crucible to a pour basin is depicted according to the principles of the present invention. The term. "quiescent-fill", as used herein, is meant to refer to a method of filling a ladle with molten material having as minimal turbulence, agitation and folding action as possible.

Figure 9:
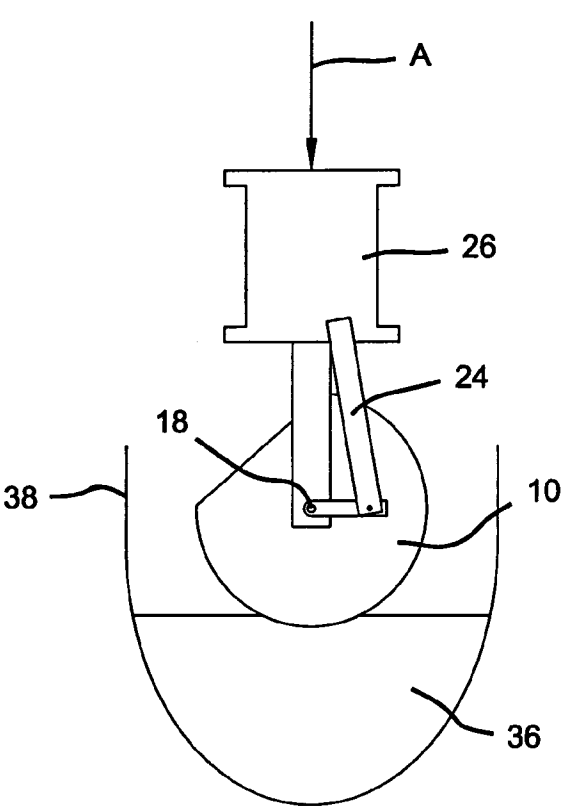
FIG. 9 is a diagrammatic representation of lowering the ladle to the surface of the molten material.
Figure 11:
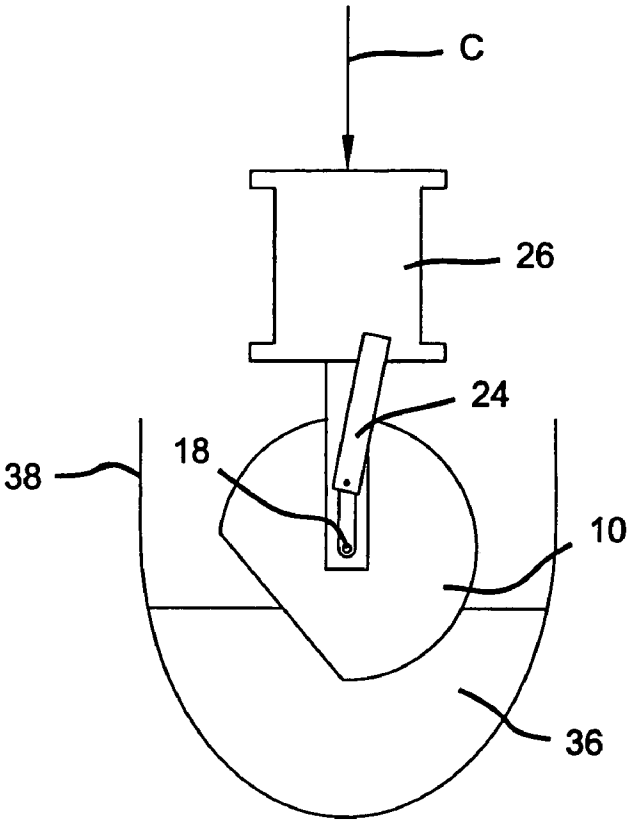
FIG. 11 is a diagrammatic representation of lowering the ladle into the molten material.
Figure 10:
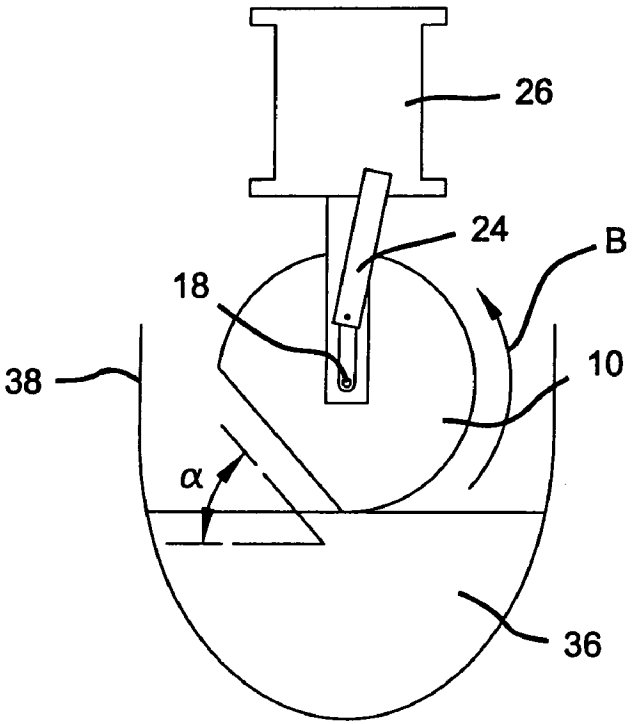
FIG. 10 is a diagrammatic representation of rotating the ladle and exposing the ladle opening to the molten material.
Figure 13:
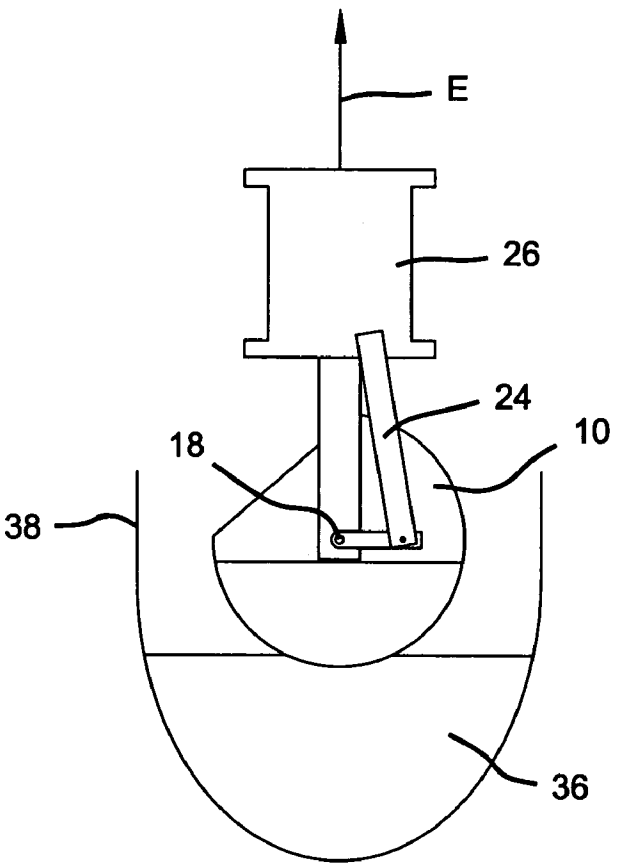
FIG. 13 is a diagrammatic representation of raising the ladle containing molten material from the crucible.
Figure 12:
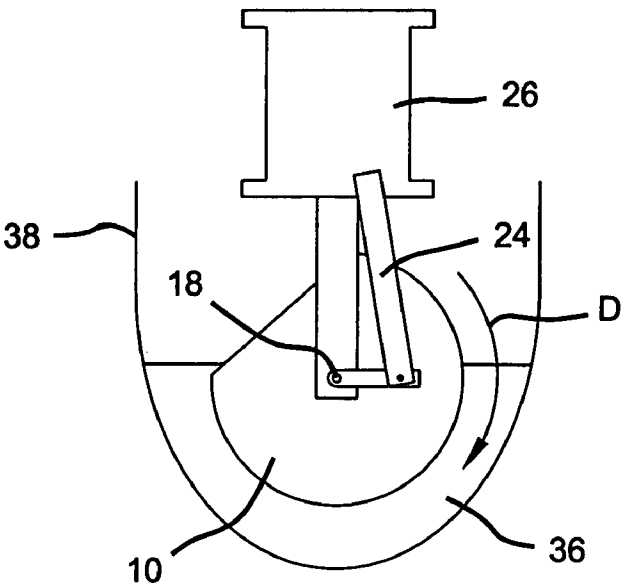
FIG. 12 is a diagrammatic representation of rotating the ladle back to its rest position.

The transferring process begins by positioning ladle 10 above a furnace dip well or crucible 38 containing the molten material 36 as shown in FIG. 8. In a preferred embodiment, controlled by an automated foundry robot 40, such as those commercially available from ABB Ltd. of Sweden, ladle 10 is lowered at a practical speed, in the direction of reference arrow A, to the surface of the molten material such that the ladle makes an initial contact with molten material 36 as shown in FIG. 9. By retracting a piston cylinder mechanism 24, ladle 10 is rotated in the direction of reference arrow B, such that ladle opening 20 is exposed to the molten material 36 as shown in FIG. 10. Ideally, angle α between the molten material 36 and the ladle opening 20 is less than 90°. Otherwise, molten material 36 may forcefully flow into ladle 10 causing material fold-over. As ladle 10 is rotated, it skims the molten material surface, revealing a clean metal surface by pushing back any surface contamination, such as dross, that may be present on the molten material. Once ladle 10 is rotated to a desired position, opening 20 of ladle 10 is lowered in the direction of reference arrow C through the clean molten surface to a predetermined depth into crucible 38 containing molten material 36, as shown in FIG. 11. This predetermined depth determines the volume of molten material which will be retained in ladle 10 and later transferred to pour basin 50. As shown in FIG. 12, cylinder mechanism 24 then is extended, thereby rotating ladle 10 back to its rest position, shown by reference arrow D, while scooping under the molten material and filling ladle 10. Ladle 10 is then raised out of crucible 38, as shown by reference arrow E of FIG. 13, and can be positioned over pour basin 50.

Preferably, ladle 10 is positioned to incorporate a minimal metal drop of less than 1 inch when molten material is poured from spout 22 to the bottom wall 56 of pour basin 50. Once properly aligned, ladle 10 is rotated by retracting cylinder mechanism 24 at a desired rate to pour approximately 10 lbs. of metal per second enabling the laminar flow of molten material through pour basin 50 into a mold via sprue 54. Alternatively, the movement of a robot arm may tilt the ladle about 10 degrees per second, causing metal to flow into the basin. Preferably, the resulting velocity of molten material through pour basin 50 is less than about 0.5 meters per second. The upper limit is determined when turbulent flow occurs and the lower limit is determined when the sprue does not remain full of metal during the entire pour. Both limits depend, in part, on the sprue diameter and chokes that may be present further in the gating system.

In one preferred embodiment, the molten material enters and exits at the same end of ladle opening 20. In an alternate embodiment, ladle 10 could be dipped into crucible 38 using a first end 21 of ladle opening 20, which may or may not have a spout or window area cut out of its rim 19, and poured from a second end 23, opposite the first end 21, that preferably has an integrated pour spout 22. This dual sided use provides a greater area for spill off, and potentially keeps any skin that may have formed from a spill off away from pour spout 22 so it will not enter the mold sprue.

It should be understood that the method of the present invention contemplates using both the ladle and pour basin described under the principles of the present invention. However, it should be appreciated that ladle 10 can be used together with other pour basin designs, and similarly, pour basin 50 can be used together with other ladle designs. Further, while the ladle and pour basin of the present invention are contemplated for use in lost foam casting processes, the ladle may also be used for sand casting processes and applications. In a sand casting process, the potential exists to form the pour basin of the invention directly into the top of the mold.

Table 1 shows a comparison of the mechanical properties of a cast metal using 6 castings per data point for both the conventional casting apparatus and methods, and using the ladle, pour basin and method of the present invention. As shown, the tensile strength is increased by about 10 percent, measured by both bolt boss and head deck. Similarly the percent elongation is substantially increased by more than 130 percent and 60 percent, measured by both bolt boss and head deck, respectively. The percent porosity decreased by about 75 percent, and the maximum feret diameter decreased by more than 35 percent. The Brinell hardness number remains about the same for both casting methods.

TABLE 1

Mechanical Properties

| | Conventional Design | Current Design |
|---|---|---|
| Ultimate Tensile Strength (MPa) | | |
| Bolt Boss | 204.33 | 224.00 |
| Head Deck | 208.17 | 230.50 |
| Elongation (%) | | |
| Bolt Boss | 0.090 | 0.210 |
| Head Deck | 0.105 | 0.170 |
| Brinell Hardness Number | 96.92 | 96.30 |
| Porosity (%) | 1.79 | 0.46 |
| Maximum Feret Diameter (μm) | 763.67 | 470.00 |

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of transferring molten material from a:

crucible to a pour basin using a ladle comprising an opening for receiving and discharging molten material, the method comprising:

positioning the ladle in a rest position over the crucible;

lowering the ladle through a dross surface of the melt and making initial contact between the ladle and the molten material;

rotating the ladle thereby moving the dross material and revealing a clean molten surface:

exposing a portion of the ladle opening to the clean molten surface;

lowering the ladle to a predetermined depth into the crucible;

rotating the ladle back to its rest position;

raising the ladle containing molten material from the crucible;

positioning the ladle over the pour basin; and transferring the molten material from the ladle to the pour basin.

2. The method of claim 1, wherein positioning the ladle over the pour basin comprises vertically aligning the ladle to less than about 1 inch from the pour basin.

3. The method of claim 1, wherein lowering the ladle to a predetermined depth into the crucible corresponds to a volume of molten material transferred within the ladle.

4. The method of claim 3, wherein rotating the ladle from the rest position comprises rotating the ladle such that an angle $\alpha$ formed between the ladle and the molten material is less than about 90 degrees.

5. The method of claim 1, further comprising providing an automated foundry robot control and manipulating the ladle movement using the robot.

6. The method of claim 1, further comprising selecting the molten material from the group consisting of: aluminum, magnesium, copper based alloys, and mixtures thereof.

7. The method of claim 1, further comprising transferring the molten material from the crucible to the pour basin in a manner to substantially minimize turbulence and/or metal fold-over.

8. The method of claim 1, further comprising providing a barrel-shaped ladle operable to rotate about an eccentric axis of rotation, wherein the ladle is equipped with an opening having a first end with a substantially planar rim and a second end opposite the first end with an integrated cut-out spout.

9. The method of claim 8, further comprising transferring the molten material from the ladle to the pour basin by pouring the molten material out of the second end of the ladle opening using the integrated cut-out spout.

10. The method of claim 8, wherein rotating the ladle and exposing a portion of the ladle opening to the molten material comprises exposing the first end of the ladle opening to the molten material; and further wherein transferring the molten material from the ladle to the pour basin comprises pouring the molten material through the integrated spout of the second end of the ladle.

11. The method of claim 1, further comprising providing a retractable cylinder mechanism and rotating the ladle by selectively extending and retracting the cylinder.

12. The method of claim 1, further comprising transferring the molten material from the ladle to the pour basin in a manner providing a velocity of molten material flowing through the pour basin less than about 0.5 m/s.

* * * * *